US010476222B2

(12) United States Patent
You et al.

(10) Patent No.: US 10,476,222 B2
(45) Date of Patent: Nov. 12, 2019

(54) PLUG-INTEGRATED ADAPTOR

(71) Applicant: SAMSUNG ELECTRONICS CO., LTD., Suwon-si (KR)

(72) Inventors: Tae-Jun You, Suwon-si (KR); Young Soo Kim, Hwaseong-si (KR); Gil Yong Chang, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 16/069,750

(22) PCT Filed: Jan. 10, 2017

(86) PCT No.: PCT/KR2017/000332
§ 371 (c)(1),
(2) Date: Jul. 12, 2018

(87) PCT Pub. No.: WO2017/122989
PCT Pub. Date: Jul. 20, 2017

(65) Prior Publication Data

US 2018/0375274 A1 Dec. 27, 2018

(30) Foreign Application Priority Data

Jan. 12, 2016 (KR) ..... 10-2016-0003496

(51) Int. Cl.
*H01R 35/04* (2006.01)
*H01R 13/04* (2006.01)
(Continued)

(52) U.S. Cl.
CPC ..... *H01R 35/04* (2013.01); *H01R 13/04* (2013.01); *H01R 13/11* (2013.01); *H01R 13/514* (2013.01);
(Continued)

(58) Field of Classification Search
CPC ..... H01R 35/04; H01R 13/6675; H01R 13/6658; H01R 13/665
See application file for complete search history.

(56) References Cited

U.S. PATENT DOCUMENTS 5,613,863 A * 3/1997 Klaus ..... H01R 27/00 439/131
5,744,934 A * 4/1998 Wu ..... H01R 13/6675 307/150
(Continued)

FOREIGN PATENT DOCUMENTS

JP 2007-311196 A 11/2007
KR 2002-0065232 A 8/2002
(Continued)

OTHER PUBLICATIONS

International Search Report dated Mar. 20, 2017, issued by the International Searching Authority in counterpart International Patent Application No. PCT/KR2017/000332 (PCT/ISA/210).
(Continued)

*Primary Examiner* — Ross N Gushi
(74) *Attorney, Agent, or Firm* — Sughrue Mion, PLLC

(57) ABSTRACT

Disclosed is a plug-integrated adaptor that improves usability of a power strip by reducing interference with adjacent plugs when the adaptor is used in the power strip. A plug-integrated adaptor includes a case body having an open side and a printed circuit board therein, a case base provided to cover the open side of the case body and including a first side extending in a first direction and a second side having a length shorter than a length of the first side, a plug having a pair of pins arranged in a second direction and a plug case protruding from the case base and extending in the second direction, and a connecting member coupled to the pin of the plug and connecting the plug to the printed circuit board. The plug case extending in the second direction is inclined
(Continued)

at an angle with a range of 0 to 45 degrees with respect to the case base extending in the first direction.

14 Claims, 10 Drawing Sheets

(51) Int. Cl.
*H01R 13/514* (2006.01)
*H01R 31/06* (2006.01)
*H01R 13/11* (2006.01)
*H01R 103/00* (2006.01)
*H01R 24/28* (2011.01)

(52) U.S. Cl.
CPC ..... *H01R 31/065* (2013.01); *H01R 24/28* (2013.01); *H01R 2103/00* (2013.01)

(56) References Cited

U.S. PATENT DOCUMENTS 6,109,977 A * 8/2000 Baxter ..... H01R 13/04 439/171
6,312,271 B1 * 11/2001 Tseng ..... H01R 13/44 439/131
6,364,716 B1 * 4/2002 Seo ..... H01R 35/04 439/174
6,371,815 B1 * 4/2002 Wetzel ..... H01R 27/00 320/115
6,845,023 B2 * 1/2005 Philips ..... H01R 31/065 363/132
7,168,968 B1 * 1/2007 Li ..... H01R 13/213 439/172
7,168,969 B1 * 1/2007 Wang ..... H01R 13/213 439/173
7,179,105 B1 * 2/2007 Hung ..... H01R 13/6675 439/172
7,264,492 B2 * 9/2007 Liang ..... H01R 13/22 439/151
7,287,991 B1 * 10/2007 Li ..... H01R 35/04 439/131
7,300,297 B1 * 11/2007 Wang ..... H01R 13/2442 439/173
7,462,074 B1 * 12/2008 Devlin ..... H01R 13/652 439/106
7,573,159 B1 * 8/2009 Deluliis ..... H01R 31/065 307/150
7,621,765 B1 * 11/2009 Wu ..... H01R 31/06 439/173
7,632,119 B1 * 12/2009 Ma ..... H01R 31/06 439/172
7,658,625 B2 * 2/2010 Jubelirer ..... H01R 31/065 439/131
7,753,721 B1 * 7/2010 Wu ..... H01R 13/6275 431/131
7,787,238 B2 * 8/2010 Liao ..... H01R 31/065 174/50
7,874,853 B2 * 1/2011 Chiang ..... H01R 13/514 439/173
7,946,868 B1 * 5/2011 Chen ..... H01R 13/625 439/173
7,946,884 B2 * 5/2011 Chiang ..... H01R 27/00 439/173
8,022,668 B2 * 9/2011 Wang ..... H02J 7/0042 320/107
8,033,847 B1 * 10/2011 Chen ..... H01R 13/652 439/172
8,079,877 B1 * 12/2011 Lai ..... H01R 24/30 439/172
8,089,244 B2 * 1/2012 Zhang ..... H01R 24/68 320/107
8,096,817 B2 * 1/2012 Lee ..... H01R 35/04 439/104
8,182,274 B1 * 5/2012 Cheng ..... H01R 13/652 439/131
8,197,260 B2 * 6/2012 Wadsworth ..... H01R 31/065 439/13
8,215,976 B2 * 7/2012 Peng ..... H01R 31/06 439/173
8,267,705 B2 * 9/2012 Huang ..... H01R 31/06 439/171
8,382,526 B2 * 2/2013 Chen ..... H01R 31/06 439/173
8,388,352 B1 * 3/2013 ChongYu ..... H01R 24/28 439/11
8,414,318 B1 * 4/2013 Chen ..... H01R 35/04 439/173
8,465,307 B2 * 6/2013 Shieh ..... H01R 31/06 439/173
8,512,056 B2 * 8/2013 Wen ..... H01R 31/065 439/172
8,579,656 B2 * 11/2013 Huang ..... H01R 35/04 439/171
8,790,124 B2 * 7/2014 Lee ..... H01R 13/642 439/131
8,979,549 B2 * 3/2015 Lin ..... H01R 13/46 439/31
9,166,351 B1 * 10/2015 Wang ..... H01R 27/00
9,270,066 B2 * 2/2016 Loh ..... H01R 24/66
9,325,098 B2 * 4/2016 Chen ..... H01R 13/44
9,537,276 B1 * 1/2017 Cai ..... H01R 31/06
9,543,704 B1 * 1/2017 Hsu ..... H01R 13/645
9,660,391 B1 * 5/2017 Kim ..... H01R 13/055
9,716,329 B1 * 7/2017 Tien ..... H01R 24/28
9,793,649 B1 * 10/2017 Lin ..... H01R 13/60
9,893,479 B1 * 2/2018 Musick ..... H01R 24/30
9,941,650 B2 * 4/2018 Tien ..... H01R 24/66
10,153,604 B1 * 12/2018 Hsu ..... H01R 33/94
10,177,585 B2 * 1/2019 Hinojosa ..... H02J 7/0045
2003/0076070 A1 * 4/2003 Wang ..... H01R 7/0042 320/111
2004/0132328 A1 * 7/2004 Wu ..... H01R 31/065 439/172
2004/0209499 A1 * 10/2004 Chung ..... H01R 33/945 439/131
2005/0269987 A1 * 12/2005 Lin ..... H01R 31/065 320/115
2006/0110963 A1 * 5/2006 Cheng ..... H01R 13/6675 439/171
2007/0091545 A1 * 4/2007 Wong ..... H01R 35/04 361/600
2007/0164704 A1 * 7/2007 McGinley ..... H01R 13/6658 320/114
2008/0268691 A1 * 10/2008 Chen ..... H01R 13/506 439/345
2009/0093163 A1 * 4/2009 Tsai ..... H01R 13/502 439/620.21
2009/0225486 A1 * 9/2009 Wadsworth ..... H01R 31/065 361/118
2010/0120278 A1 * 5/2010 Yang ..... H01R 35/04 439/171
2011/0021040 A1 * 1/2011 Garb ..... H01R 31/065 439/13
2011/0117766 A1 5/2011 Chen
2011/0151718 A1 * 6/2011 Lu ..... H01R 31/02 439/620.21
2013/0316553 A1 * 11/2013 Lee ..... H01R 35/04 439/131
2016/0134071 A1 * 5/2016 Toh ..... H01R 35/04 439/13
2017/0170614 A1 * 6/2017 You ..... H01R 13/506
2018/0013250 A1 * 1/2018 Judkins ..... H01R 13/6675
2018/0083382 A1 * 3/2018 Li ..... H01R 13/6658
2018/0191117 A1 * 7/2018 Wu ..... H01R 13/447
2018/0241164 A1 * 8/2018 Jiang ..... H01R 13/5219
2018/0294602 A1 * 10/2018 Wu ..... H01R 13/6275

(56) References Cited

U.S. PATENT DOCUMENTS

| | | | | |
|---|---|---|---|---|
| 2018/0342840 | A1* | 11/2018 | Messinger | H01R 13/6675 |
| 2018/0375274 | A1* | 12/2018 | You | H01R 13/04 |

FOREIGN PATENT DOCUMENTS

| | | | |
|---|---|---|---|
| KR | 10-0826430 | B1 | 4/2008 |
| KR | 10-1346116 | B1 | 1/2014 |
| KR | 10-2014-0065890 | A | 5/2014 |

OTHER PUBLICATIONS

Written Opinion dated Mar. 20, 2017, issued by the International Searching Authority in counterpart International Patent Application No. PCT/KR2017/000332 (PCT/ISA/237).
Communication dated Sep. 28, 2018 issued by the European Patent Office in counterpart European Application No. 17738618.2.

* cited by examiner

PLUG-INTEGRATED ADAPTOR

TECHNICAL FIELD

The present disclosure relates to a plug adaptor, and more particularly, to a plug adaptor that improves usability of adjacent plug when a power strip is used.

BACKGROUND ART

Generally, electronic devices have different voltages to be used depending on the type and usage of electronic devices, and the shapes of input parts of the electronic devices to which power is supplied are also different according to each product.

Accordingly, in order to supply power to an electronic device, it is necessary to provide a power source of an appropriate voltage used in the electronic device through a connector having a shape suitable for an input part of the electronic device, and what performs this function is a power conversion supply apparatus, that is a power adaptor.

Particularly, a power adaptor is widely used as a device for converting AC power into DC power and supplying it to various electronic devices such as a notebook computer, a personal computer (PC), a display monitor, and a mobile phone using a DC power source. The power adaptor is used as a device for charging a battery or generating a required output power from an input power source and supplying power necessary for driving an electronic device.

The power adaptor includes a main body having an AC/DC conversion circuit and a transformer circuit, a plug connected to a power outlet, and a connector connected to an electronic device. The power adaptor converts the high voltage AC power input through the power outlet into a DC power of an appropriate voltage and supplies the DC power to the electronic device.

Conventional plug-integrated adaptors have problems in that the usability of the power strip is limited due to interference with adjacent outlets when used in the outlets of the power strip.

DISCLOSURE

Technical Problem

It is an aspect of the present disclosure to provide a plug-integrated adaptor that improves usability of a power strip by reducing interference with adjacent plugs when the adaptor is used in the power strip.

Technical Solution

In accordance with an aspect of the present disclosure, a plug-integrated adaptor includes a case body having an open side and a printed circuit board therein, a case base provided to cover the open side of the case body and including a first side extending in a first direction and a second side having a length shorter than a length of the first side, a plug having a pair of pins arranged in a second direction and a plug case protruding from the case base and extending in the second direction, and a connecting member coupled to the pin of the plug and connecting the plug to the printed circuit board, wherein the plug case extending in the second direction is inclined at an angle with a range of 0 to 45 degrees with respect to the case base extending in the first direction.

A length of the plug case in the second direction may be longer than the length of the second side of the case base.

A length of a side of the case body corresponding to the second side of the case base may be not longer than the length of the second side.

The connecting member may include a plug fastening portion to which the pin of the plug is fastened, a board connecting portion connected to the printed circuit board, and an extending portion connecting the plug fastening portion and the board connecting portion.

The plug fastening portion may include a fastening hole into which the pin of the plug is inserted, and at least one fastening protrusion protruding toward a center of the fastening hole and configured to be in contact with and press the pin of the plug.

The board connecting portion may include a connection terminal which is in contact with the printed circuit board at one end thereof, and the other end of the board connecting portion may be connected to the extending portion.

The extending portion may include a first extension extending from the plug fastening portion, a second extension bent at and extending from a distal end of the first extension, and a third extension bent at and extending from a distal end of the second extension to be connected to the board connection portion.

The third extension may include a first section and a second section, the first section may be bent at and extending from the distal end of the second extension, and the second section may be bent at an angle with a range of 0 to 45 degrees at an end of the first section and connected to the board connection portion.

The connecting member may include a first connecting member and a second connecting member, and the first connecting member and the second connecting member may be configured such that lengths of the first extensions are different from each other and lengths of the third extensions are different from each other.

The printed circuit board may include at least one terminal hole configured to be in contact with the connection terminal.

The connecting member and the printed circuit board may be connected by soldering, and a soldering portion of the connecting member is plated so as not to generate cold solder joint.

The second direction may be inclined at 12 degrees with respect to the first direction.

In accordance with another aspect of the present disclosure, a plug-integrated adaptor includes a case body having an open side and a printed circuit board therein, a case base provided to cover the open side of the case body and including a first side extending in a first direction and a second side having a length shorter than a length of the first side, a plug having a pair of pins arranged in a second direction and a plug case protruding from the case base and extending in the second direction, and a connecting member coupled to the pin of the plug and connecting the plug to the printed circuit board, wherein a length of the plug case in the second direction is longer than a length of the second side of the case base, and the second direction is inclined at a predetermined angle with respect to the first direction.

Advantageous Effects

In accordance with an aspect of the present disclosure, it may be possible to provide a plug-integrated adaptor that improves usability of a power strip by reducing interference with adjacent plugs when the adaptor is used in the power strip.

In accordance with an aspect of the present disclosure, it may be possible to provide a plug-integrated adaptor in which the pin of the plug is inclined at a predetermined angle with respect to a main body of the adaptor.

MODE FOR INVENTION

Hereinafter, exemplary embodiments according to the present disclosure will be described in detail. The terms "front end", "rear end", "upper", "lower", "upper end" and "lower end" used in the following description are defined based on the drawings. The shape and position of each component should not be limited by these terms.

Figure 1:
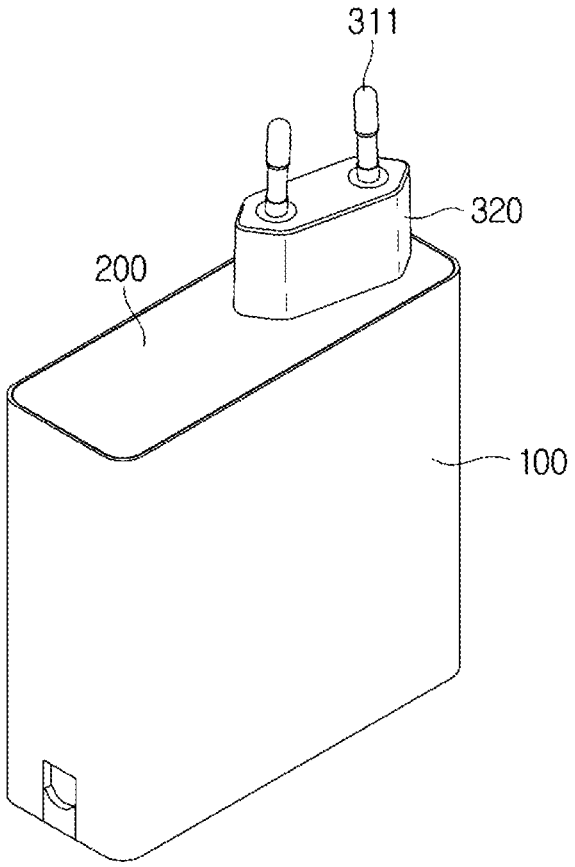
FIG. 1 is a perspective view illustrating a plug-integrated adaptor according to an embodiment of the present disclosure.
Figure 2:
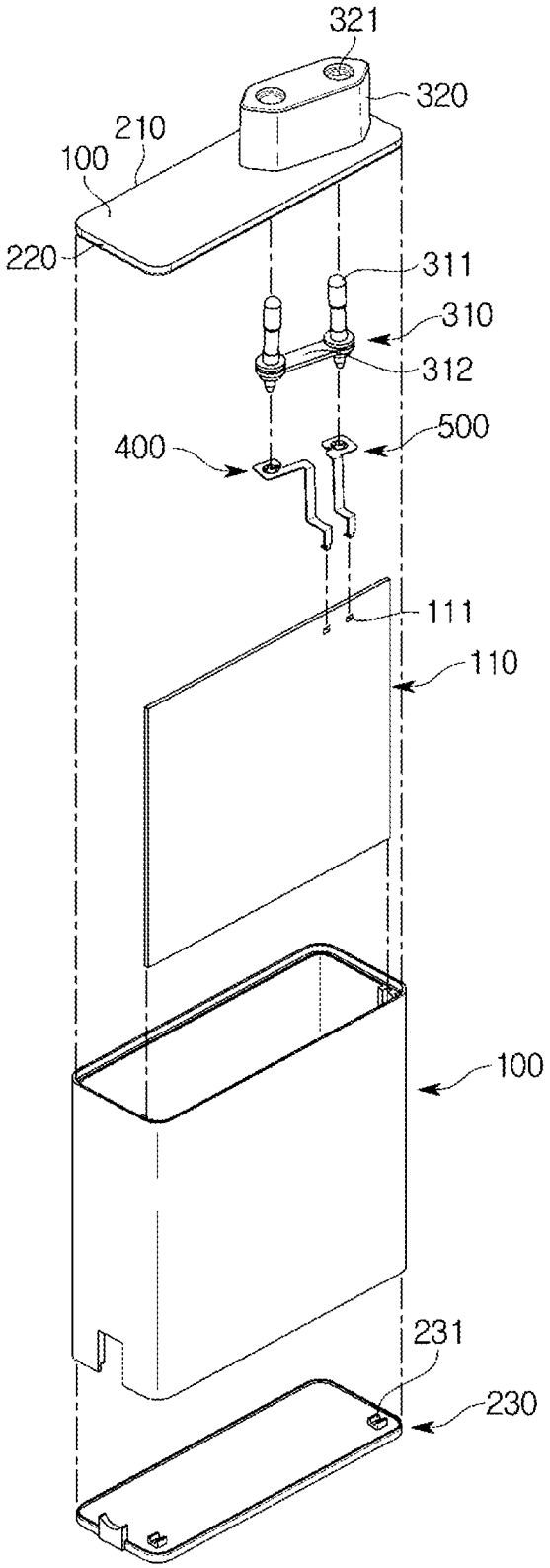
FIG. 2 is an exploded perspective view of the plug-integrated adaptor of FIG.
Figure 3:
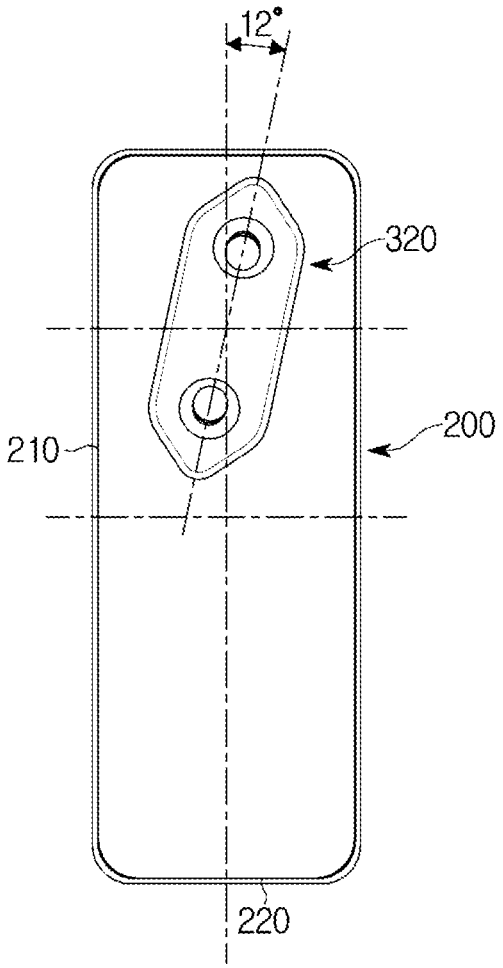
FIG. 3 is a top plan view of the plug-integrated adaptor of FIG. 1.

FIG. 1 is a perspective view illustrating a plug-integrated adaptor according to an embodiment of the present disclosure, FIG. 2 is an exploded perspective view of the plug-integrated adaptor of FIG. 1, and FIG. 3 is a top plan view of the plug-integrated adaptor of FIG. 1.

As illustrated in FIGS. 1 to 3, a plug-integrated adaptor according to an embodiment of the present disclosure includes a plug 300, a case body 100, connecting members 400 and 500, and a case base.

The plug 300 includes a pin assembly 310 and a plug case 320. The pin assembly 310 includes a pair of pins 311 and a pin connecting portion 312 for connecting the pair of pins 311.

The case body 100 includes a printed circuit board 110 therein, and at least one side thereof may be opened. The plug-integrated adaptor according to the embodiment of the present disclosure has an upper surface and a lower surface opened. The opened upper surface is covered by the case base 200, which will be described later, and the opened lower surface is covered by the case cover 230.

One ends of the connecting member 400 and 500 are coupled to the pins 311 of the plug 300 and the other ends of the connecting member 400 and 500 are provided to contact the printed circuit board 110. Thus, the connecting members 400 and 500 electrically connect the plug 300 and the printed circuit board 110.

The case base 200 is provided to cover the open side of the case body 100 as described above. The case base 200 may include a first side 210 extending in a first direction and a second side 220 having a length shorter than a length of the first side 210. In the plug-integrated adaptor according to the embodiment of the present disclosure, the case base 200 is provided as a substantially rectangular flat plate and has rounded corners. The first side 210 is longer side, and the second side 220 is shorter than the first side 210 and has a direction intersecting with the first side 210.

A length of a side of the case body 100 corresponding to the second side 220 of the case base 200 is provided not to be longer than the length of the second side 220 described above. The side of the case body 100 is provided not to be longer than the second side 220 of the case base 200 such that a width of the case body 100 is not wider than the length of the second side 220. This is to prevent the case body 100 from interfering with the adjacent plugs irrespective of an angle of the plug case 320, which will be described later, by making the width of the case body 100 larger than a certain level. That is, even if a length of the case body 100 is long, it does not cause the case body to interfere with the adjacent plugs. However, it is possible to prevent the case body 100 from interfering with the adjacent plugs due to the width of the case body 100 being long. According to the embodiment of the present disclosure, as shown in the figures, the case base 200 and the case body 100 are provided so that their shapes correspond to each other.

Figure 9:
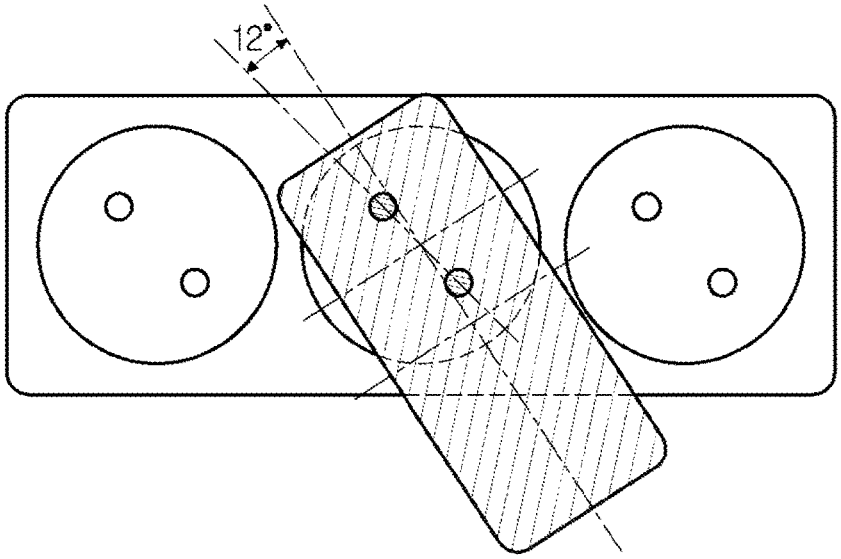
FIG. 9 is a top plan view illustrating a state where a plug-integrated adaptor according to an embodiment of the present disclosure is connected to a power strip.
Figure 10:
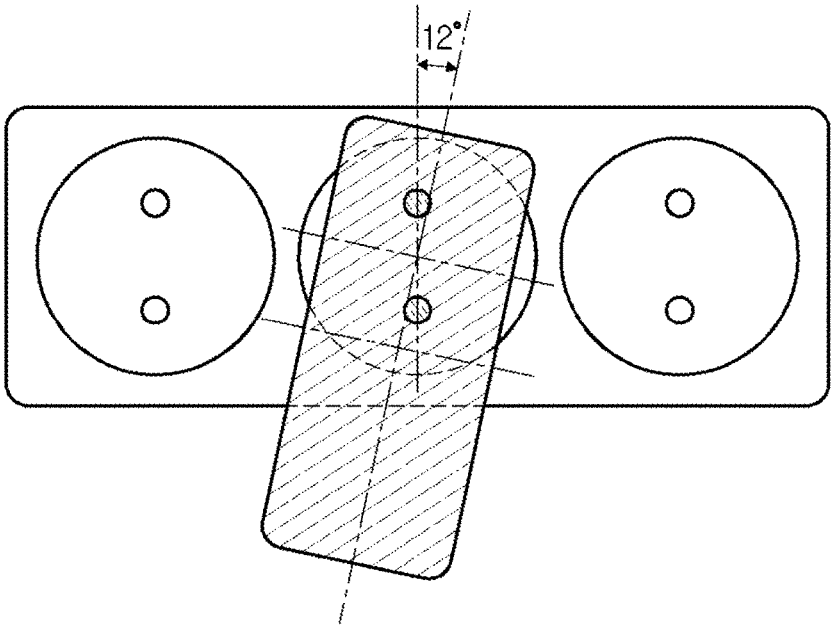
FIG. 10 is a top plan view illustrating a state in which a plug-integrated adaptor according to an embodiment of the present disclosure is connected to a power strip different from that of FIG. 9.

As illustrated in FIG. 3, a plug case 320 is provided on one side of the case base 200. The plug case 320 is inclined with respect to the case base 200 at an angle with a range of 0 to 45 degrees. As a result, as shown in FIGS. 9 and 10, it is possible to use the plug-integrated adaptor in two different kinds of power strips without interference with adjacent plugs. That is, a conventional plug-integrated adaptor has a problem that the plug case 320 is designed to have an angle of 0 degree or 90 degrees with respect to the case base 200, causing interference with adjacent plugs when used in the power strip. However, the plug-integrated adaptor according to the present disclosure is provided such that the plug case 320 is inclined at an angle with the range of 0 to 45 degrees with respect to the case base 200, thereby preventing interference with the adjacent plugs. For example, as illustrated in FIG. 9, when the length of the second side 220 of the case base 200 is approximately 31 mm, the plug case 320 may be configured to be inclined at about 12 degrees with respect to the second side 220 of the case base 200. In this case, the adaptor body and the adjacent power outlet are brought into contact with each other, and the adaptor does not interfere with the use of the adjacent outlet. Therefore, the plug-integrated adaptor according to the present disclosure has an advantage of improving usability of a power strip since it does not cause interference with the adjacent plug when used in the power strip.

The plug case 320 is provided to extend in a second direction. The second direction indicates the direction in which the pair of pins 311 is arranged. Also, the second direction is inclined at an angle with the range of 0 to 45 degrees with respect to the first direction as described above.

The plug case 320 is provided to protrude from the case base 200. According to the embodiment of the present disclosure, the plug case 320 protrudes upward from the case base 200.

A pair of insertion holes 321 may be formed at the plug case 320. The insertion holes 321 are where the pair of pins 311 is inserted, and formed in a size and shape corresponding to a cross section of the pins 311 of the plug.

The plug case 320 may be integrally formed with the case base 200. For example, the plug case 320 and the case base 200 may be integrally injection-molded.

The pin assembly 310 includes the pair of pins 311 and the pin connecting portion 312 for connecting the pair of pins 311 as described above.

The pair of pins 311 are provided in the form of a conductive rod with one end received in the plug case 320 and the other end exposed to the outside of the plug case 320. The other end exposed to the outside is inserted into an outlet (not shown) to receive power.

According to the embodiment of the present disclosure, the one ends of the pair of pins 311 are inserted through the insertion holes 321 of the plug case 320 and fastening holes 411 and 511 of the connecting members 400 and 500. Through which the pins 311 of the plug are physically and electrically connected to the connecting members 400 and 500.

The pin connecting portion 312 connects and restrains the pair of pins 311 so that the pair of pins 311 is used integrally. In addition, the pin connecting portion 312 fixes the pair of pins 311 so as to be arranged side by side. When a portion of the pin 311 to be inserted into an outlet (not shown) is referred to as an upper portion of the pin 311 and a portion to be connected to the connecting member 400 or 500 to be described later is referred to as a lower portion of the pin 311, the pin connecting portion 312 may be provided on one side of the lower portion of the pin 311.

Figure 6:
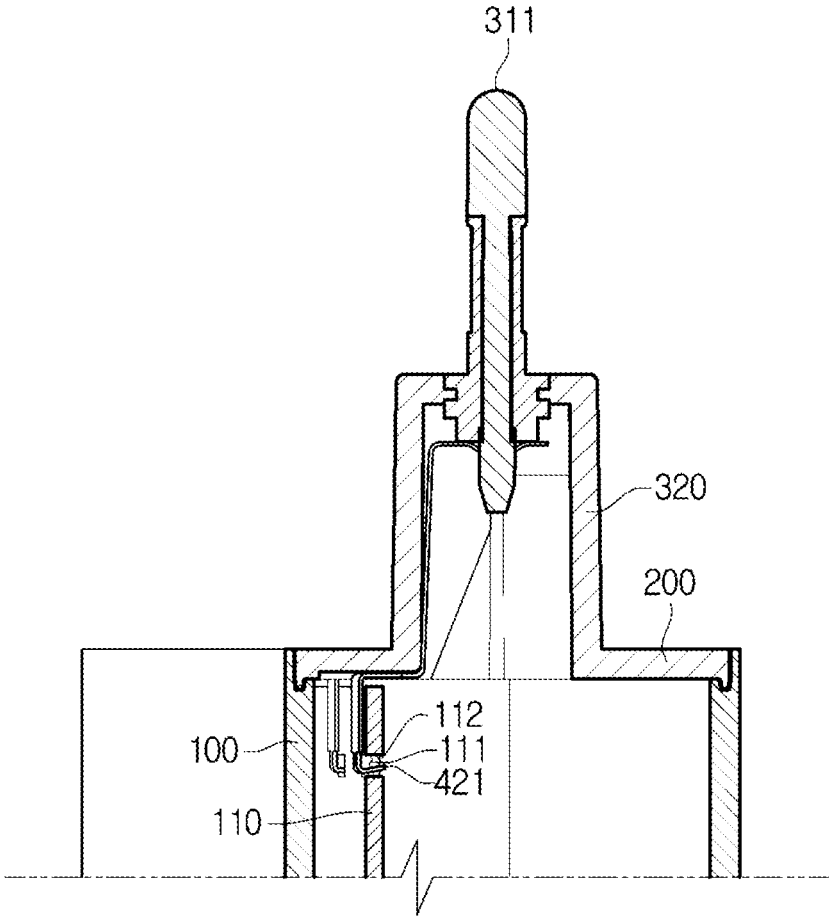
FIG. 6 is a cross-sectional view of FIG. 5 taken at a different angle.
Figure 7:
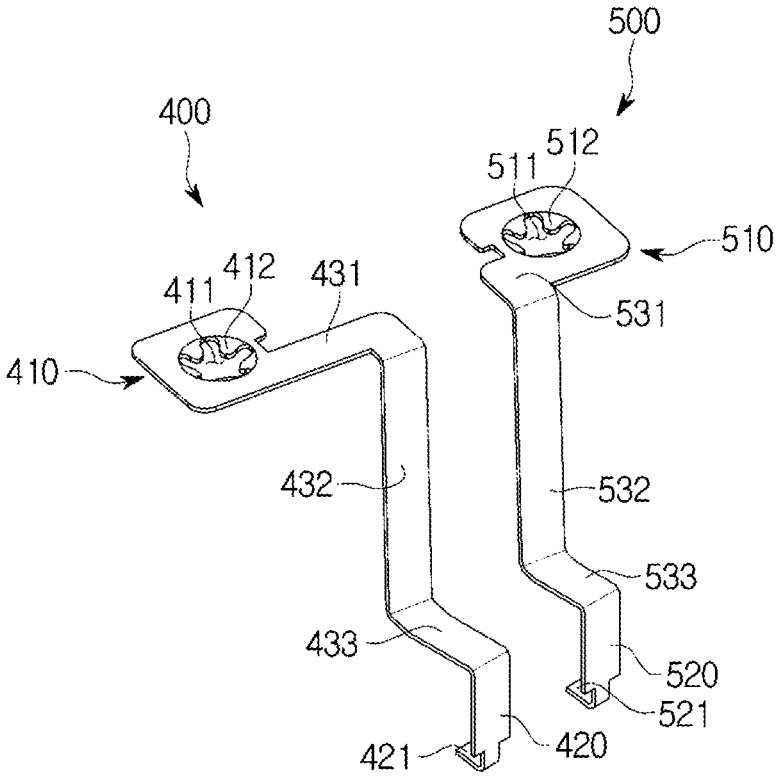
FIG. 7 is a perspective view illustrating a connecting member of the plug-integrated adaptor of FIG. 1.
Figure 8:
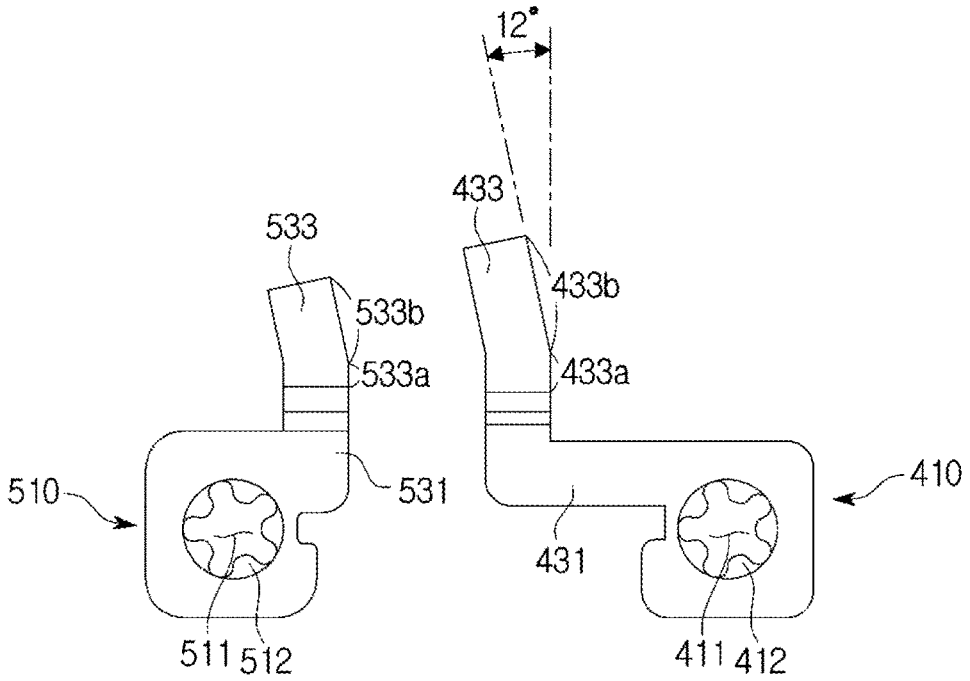
FIG. 8 is a top plan view illustrating the connecting member of FIG. 7.

The plug case 320 including the pin assembly 310 may be formed by insert injection molding. The plug case 320 may be formed by injection molding and the pins 311 and the pin connecting portion 312 of the conductive material may be separately provided from the plug case 320. According to this embodiment, as shown in FIGS. 6 to 8, the pin assembly 310 and the plug case 320 may not be coupled by fitting because there is no tolerance. Accordingly, the pin assembly 310 and the plug case 320 may be coupled by insert injection molding. That is, the plug case 320 having the pin assembly 310 coupled thereto may be provided through a process of injecting molten plastic into a mold having the pin assembly 310 inserted therein.

Figure 4:
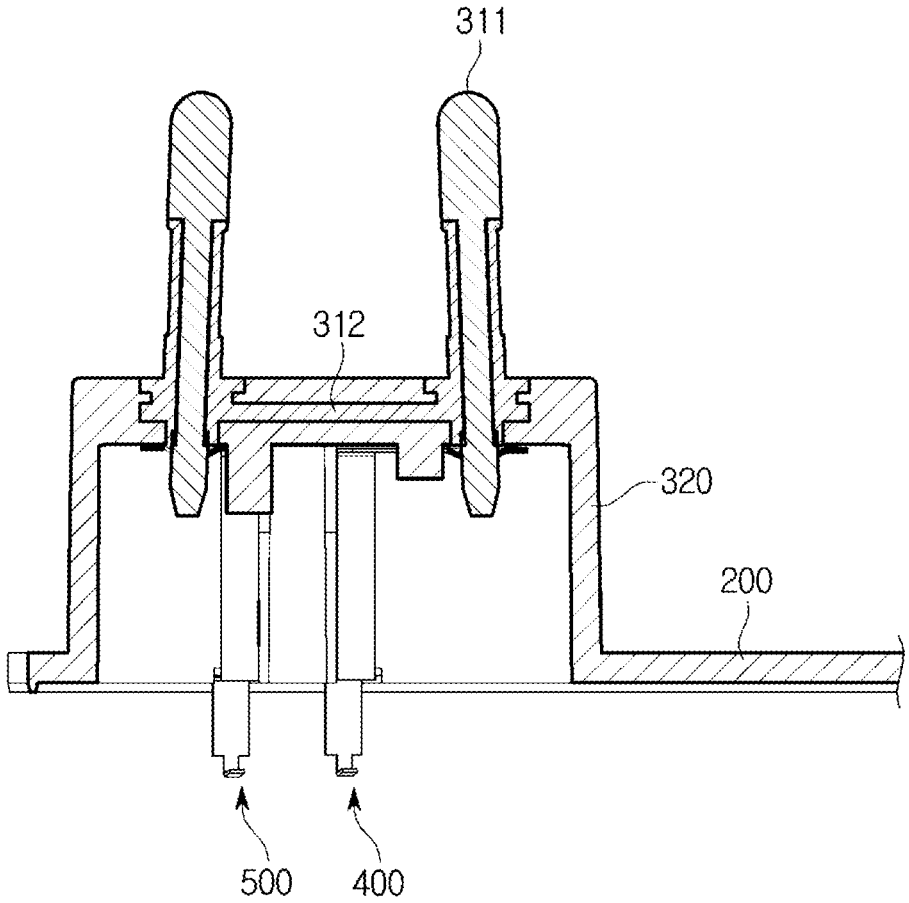
FIG. 4 is a cross-sectional view illustrating a plug and a connecting member of the plug-integrated adaptor of FIG. 1.
Figure 5:
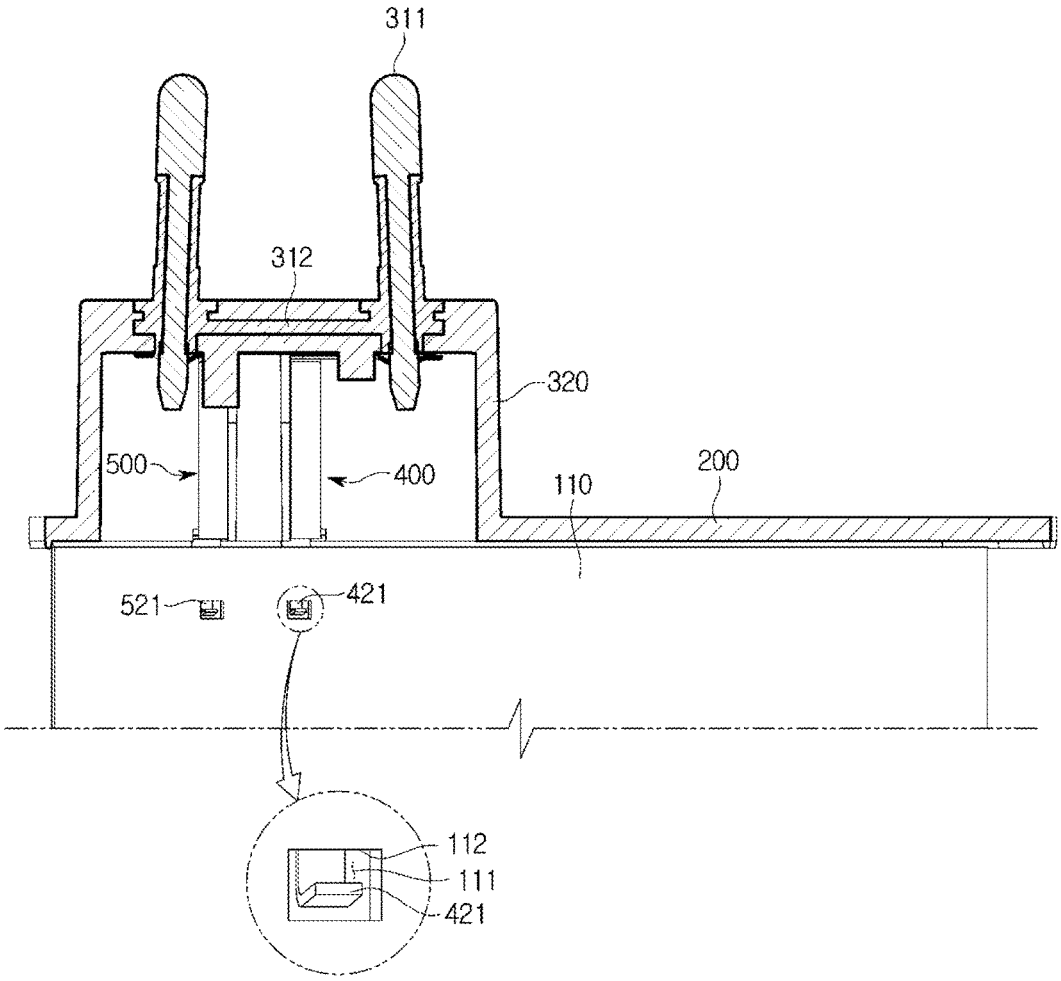
FIG. 5 is a cross-sectional view illustrating the connecting member of FIG. 4 connected to a printed circuit board.

FIG. 4 is a cross-sectional view illustrating a plug and a connecting member of the plug-integrated adaptor of FIG. 1, FIG. 5 is a cross-sectional view illustrating the connecting member of FIG. 4 connected to a printed circuit board, and FIG. 6 is a cross-sectional view of FIG. 5 taken at a different angle.

The case body 100 is provided such that at least one side thereof is opened, and includes a printed circuit board therein.

As illustrated in FIGS. 4 to 6, the printed circuit board 110 is installed in the inner space of the case body 100, and may perform the function of rectifying an AC voltage applied from the plug pin 311 to a DC voltage of a desired level through a transformer (not shown).

A pair of terminal holes 111 may be formed at one side of the printed circuit board 110 to connect the printed circuit board 110 to board connecting portion of the connecting members 400 and 500.

The terminal holes 111 may be formed to penetrate the printed circuit board 110 and have a size corresponding to a width of the board connection portions 420 and 520 to firmly be in contact with the board connection portions 420 and 520. According to the embodiment of the present disclosure, the pair of terminal holes 111 are disposed adjacent to an edge of the printed circuit board 110 and are provided in a substantially rectangular shape.

As illustrated in FIG. 5, a terminal portion 112 may be formed on an inner surface of the terminal hole 111 so as to be in contact with the connecting member 400 or 500. The terminal portion 112 and the connecting member 400 or 500 may be coupled by soldering as described later. The connecting members 400 or 500, and the printed circuit board 110 are electrically connected to each other by coupling the terminal portion 112 and the board connecting portion 420 or 520. Further, the plug 300 and the printed circuit board 110 are electrically connected through the connecting members 400 and 500.

In the case body 100 according to the embodiment of the present disclosure, the upper surface and the lower surface are opened as described above. The opened upper surface of the case body 100 is covered by the case base 200 and the lower surface of the case body 100 is covered by the case cover 230.

A printed circuit board support 231 for fixing the printed circuit board 110 is provided on one side of the case cover 230. The printed circuit board support 231 may be provided in plurality to stably fix and support the printed circuit board 110. According to the embodiment of the present disclosure, the printed circuit board support 231 is provided in two, as shown in the FIG. 2.

The case body 100, the case base 200, and the plug case 320 may be formed of an insulating resin material and protect the components contained therein.

FIG. 7 is a perspective view illustrating a connecting member of the plug-integrated adaptor of FIG. 1 and FIG. 8 is a top plan view illustrating the connecting member of FIG. 7.

The connecting members 400 and 500 electrically and physically connect the plug 300 and the printed circuit board 110. For this, the connecting members 400 and 500 may be formed of a conductive material.

One end of the connecting member 400 or 500 is fastened to the pin 311 of the plug 300 and the other end is brought into contact with the printed circuit board 110. The connecting members 400 and 500 are provided in a pair so as to correspond to the pair of pins 311. The connecting members 400 and 500 are fastened to the pins 311, respectively.

As illustrated in FIGS. 7 and 8, plug fastening portions 410 and 510 are provided at one ends of the connecting members 400 and 500, respectively, to which the pins 311 of the plug 300 are coupled. The plug fastening portions 410 and 510 include fastening holes 411 and 511 into which the pins 311 are inserted. The lower portion of the pin 311 is inserted into the fastening holes 411 and 511 when the portion to be inserted into an outlet (not shown) is the upper portion of the pin 311 as described above. The fastening holes 411 and 511 may be formed to correspond to the lower portion of the pin 311 so that the lower portion of the pin 311 is inserted.

The plug fastening portions 410 and 510 may include at least one fastening protrusion 412 and 512 formed to protrude into the fastening holes 411 and 511. The fastening protrusions 412 and 512 may be provided to come into contact with and press the lower portion of the pin 311. As the fastening protrusions 412 and 512 press the pin 311, the pin 311 is fastened to the plug fastening portions 410 and 510 and fixed in the fastening holes 411 and 511. It is preferable that five or more protrusions are formed in order to secure a coupling force with the pins 311.

According to the embodiment of the present disclosure, the fastening protrusion has a semicircular cross-sectional shape. Through this shape, the fastening protrusion comes into point contact with the pin 311. Since the fastening protrusion is in point contact with the pin 311 to minimize the contact area, the pins 311 can be fastened to the plug fastening portions 410 and 510 under a low pressure. Therefore, it is possible to improve workability by making the work of coupling the pins 311 to the plug fastening portions 410 and 510 facilitated.

Further, the fastening protrusion is deformed in an inclined manner in accordance with an inserting direction of the pin 311. According to the embodiment of the present disclosure, the plug fastening portions 410 and 510 are fastened to the lower portion of the pin 311. For this purpose, the plug fastening portions 410 and 510 are moved toward the lower portion of the pin 311 and press-inserted. The fastening protrusion is deformed to be inclined downwardly. The fastening protrusion is deformed to be inclined downwardly to prevent the pin 311 from moving in a direction opposite to the direction in which the pin 311 is inserted into the fastening holes 411 and 511. That is, the pin 311 is not easily separated from the fastening holes 411 and 511. In addition, since the fastening protrusion has an elastic force and generates a force to be restored, the fastening protrusion presses the pin 311. The contact area between the fastening protrusion and the pin 311 is minimized through the point contact so that the pressure applied to the pin 311 by the fastening protrusion can be concentrated and the pin 311 and the connecting members 400 and 500 can be firmly coupled. In addition, it is possible to reduce occurrence of defects such as contact failure and improve reliability.

Board connecting portions 420 and 520 are provided to be in contact with the printed circuit board 110 at the other end of the connecting members 400 and 500. Third extensions 433 and 533 to be described later are formed at one ends of the board connecting portions 420 and 520, and connection terminals 421 and 521 are provided at the other ends of the board connecting portions 420 and 520 to be in contact with the printed circuit board 110. The connection terminals 421 and 521 are inserted into the terminal holes 111 of the printed circuit board 110 and come into contact with the terminal portions 112 provided on one side of the terminal holes 111. The connection terminals 421 and 521 according to the present embodiment are formed to be bent in a hook shape. However, the present disclosure is not limited thereto, and any shape may be used as long as it is inserted into the terminal hole 111 to be in contact with the terminal portion 112.

The board connecting portions 420 and 520 are electrically and physically connected to the printed circuit board 110 by contacting the terminal portions 112 of the printed circuit board 110. According to the embodiment of the present disclosure, the terminal portions 112 and the board connecting portions 420 and 520 may be connected by soldering. Specifically, the board connecting portions 420 and 520 are inserted into the terminal holes 111 and brought into contact with the terminal portions 112 provided on one side of the terminal holes 111, and then contact portions of the terminal portions 112 and the board connecting portions 420 and 520 are soldered. Accordingly, the printed circuit board 110 and the connecting members 400 and 500 are physically and electrically connected.

A region of the board connecting portions 420 and 520 where the solder is applied may be plated before soldering. As a result, it is possible to prevent a cold solder joint, and further, to prevent defective products due to the cold solder joint.

The connection members 400 and 500 may include extending portions 430 and 530 connecting the plug fastening portions 410 and 510 to the board connecting portions 420 and 520. The extending portions 430 and 530 extend from one ends of the plug fastening portions 410 and 510 toward the board connecting portions 420 and 520, respectively. The extending portions 430 and 530 may be bent such that the connecting members 400 and 500 are easily coupled to the printed circuit board 110.

The extending portions 430 and 530 include first extensions 431 and 531, second extensions 432 and 532, and third extensions 433 and 533. The extending portions 430 and 530 may be provided in the form of a flat plate.

The first extensions 431 and 531 extend horizontally from the plug fastening portions 410 and 510. The second extensions 432 and 532 are bent at and extend perpendicularly downward from distal ends of the first extensions 431 and 531. The third extensions 433 and 533 are bent at and extend horizontally from distal ends of the second extensions 432 and 532, and the board connecting portions 420 and 520 are provided at the ends of the third extensions 433 and 533. The third extensions 433 and 533 include first sections 433*a* and 533*a*, and second sections 433*b* and 533*b*, respectively such that the plug case 320 is inclined at an angle ranging from 0 to 45 degrees with respect to the case base 200. The first sections 433*a* and 533*a* extend from the second extensions 432 and 532, and the second sections 433*b* and 533*b* are bent at an angle of 0 to 45 degrees at and extend from the ends of the first sections 433*a* and 533*a*. The board connecting portions 420 and 520 are provided at the ends of the second sections 433*b* and 533*b*. That is, the third extensions 433 and 533 include first sections 433*a* and 533*a* extending from the second extensions 432 and 532, and second sections 433*b* and 533*b* extending from the board connecting portions 420 and 520. The first sections 433*a* and 533*a* and the second sections 433*b* and 533*b* are continuously arranged. This allows the plug case 320 to be inclined at an angle ranging from 0 to 45 degrees with respect to the case base 200 without the printed circuit board 110 being arranged to be inclined with respect to the case cover 230.

As described above, the connecting members 400 and 500 are provided in a pair. That is, the connecting members 400 and 500 include the first connecting member 400 and the second connecting member 500. The first connecting member 400 and the second connecting member 500 may have different directions and lengths. A length of the first extension 431 of the first connecting member 400 may be longer than a length of the first extension 531 of the second connecting member 500. A length of the third extension 433 of the first connecting member 400 may be longer than a length of the third extension 533 of the second connecting member 500. However, the present disclosure is not limited thereto, and the connecting members 400 and 500 may have any shape as long as they are capable of connecting the printed circuit board 110 to the pair of pins 311 arranged to be inclined at a predetermined angle with respect to the case base 200.

The connecting members 400 and 500 according to the present embodiment may be formed of a conductive metal, and may be made of various materials that are not easily deformed in the manufacturing process.

In addition, a metal plate may be pressed to form flat plate-like connecting members 400 and 500, and then bent to form the plug fastening portions 410 and 510, the board connecting portions 420 and 520, and the extending portions 430 and 530.

The connecting members 400 and 500 according to the present embodiment may be provided as a pair in correspondence with the pair of pins 311 as described above. Shapes of the pair of connecting members 400 and 500 may be different from each other according to a position of the printed circuit board 110 disposed inside the case body 100. Further, in order to prevent the pair of connecting members 400 and 500 from overlapping or contacting each other, each of the extending portions 430 and 530 may be configured to extend from different positions of the plug fastening portions 410 and 510. Accordingly, the board connecting portions 420 and 520 may be disposed to be spaced apart from each other.

In the plug-integrated adaptor according to the present embodiment as described above, the pins 311 of the plug are electrically connected to the printed circuit board 110 by the connecting members 400 and 500. Since the electrical connection between the printed circuit board 110 and the connecting members 400 and 500 is easy, manufacturing is facilitated. Further, since the connecting members 400 and 500 are physically and electrically connected to the printed circuit board 110, it is possible to prevent a problem such as disconnection due to an external impact, thereby ensuring electrical contact reliability.

The plug-integrated adaptor according to the present embodiment is configured such that the terminal hole 111 is formed on one side of the printed circuit board 110 and the connecting members 400 and 500 are in contact with the terminal hole 111 of the printed circuit board 110. The distance from the pin 311 of the plug 300 to the terminal hole 111 of the printed circuit board 110 can be minimized and the printed circuit board 110 and the pins 311 of the plug 300 can be easily electrically connected in a narrow space in the case body 100. Therefore, the volume of the entire adaptor can be reduced and the internal space can be utilized more efficiently.

Although a few embodiments of the present disclosure have been shown and described, it would be appreciated by those skilled in the art that various changes may be made in these embodiments without departing from the spirit and scope of the disclosure as defined in the claims.

The invention claimed is:

1. A plug-integrated adaptor comprising:

a case body having an open side and a printed circuit board therein;

a case base provided to cover the open side of the case body and including a first side extending in a first direction and a second side having a length shorter than a length of the first side;

a plug having a first pin and a second pin arranged in a second direction and a plug case protruding from the case base and extending in the second direction;

a first connecting member directly connecting the first pin of the plug and the printed circuit board; and a second connecting member directly connecting the second pin of the plug and the printed circuit board, wherein the plug case extending in the second direction is inclined at an angle less than or equal to 45 degrees with respect to the case base extending in the first direction.

2. The plug-integrated adaptor according to claim 1, wherein a length of the plug case in the second direction is longer than the length of the second side of the case base.

3. The plug-integrated adaptor according to claim 1, wherein a length of a side of the case body corresponding to the second side of the case base is not longer than the length of the second side.

4. The plug-integrated adaptor according to claim 1, wherein one of the first connecting member and the second connecting member integrally comprises:

a plug fastening portion to which one of the first pin and the second pin of the plug is fastened;

a board connecting portion connected to the printed circuit board; and an extending portion connecting the plug fastening portion and the board connecting portion.

5. The plug-integrated adaptor according to claim 4, wherein the plug fastening portion includes a fastening hole into which one of the first pin and the second pin of the plug is inserted, and at least one fastening protrusion protruding toward a center of the fastening hole and configured to be in contact with one of the first pin and the second pin of the plug.

6. The plug-integrated adaptor according to claim 4, wherein the board connecting portion includes a connection terminal which is in contact with the printed circuit board at one end thereof, and the other end of the board connecting portion is connected to the extending portion.

7. The plug-integrated adaptor according to claim 6, wherein the printed circuit board includes at least one terminal hole configured to be in contact h the connection terminal.

8. The plug-integrated adaptor according to claim 4, wherein the extending portion includes a first extension extending from the plug fastening portion, a second extension bent at and extending from a distal end of the first extension, and a third extension bent at and extending from a distal end of the second extension to be connected to the board connection portion.

9. The plug-integrated adaptor according to claim 8, wherein the third extension includes a first section and a second section, the first section is bent at and extending from the distal end of the second extension, and the second section is bent at an angle less than or equal to 45 degrees at an end of the first section and connected to the board connection portion.

10. The plug-integrated adaptor according to claim 9, wherein the first connecting member and the second connecting member are configured so that lengths of the first extensions are different from each other and lengths of the third extensions are different from each other.

11. The plug-integrated adaptor according to claim 1, wherein one of the first connecting member and the second connecting member and the printed circuit board are connected by soldering, and a soldering portion of one of the first connecting member and the second connecting member is plated so as not to generate cold solder joint.

12. The plug-integrated adaptor according to claim 1, wherein the second direction is inclined at 12 degrees with respect to the first direction.

13. The plug-integrated adaptor according to claim 1, wherein the plug case is fixed stationary to the case base, and wherein the plug case extending in the second direction is inclined at a predetermined angle less than or equal to 45 degrees with respect to the case base extending in the first direction.

14. A plug-integrated adaptor comprising:

a case body having an open side and a printed circuit board therein;

a case base provided to cover the open side of the case body, and including a first side extending in a first direction and a second side intersecting the first side and having a length shorter than a length of the first side;

a plug having a first pin and a second pin arranged in a second direction and a plug case protruding from the case base and extending in the second direction;

a first connecting member directly connecting the first pin of the plug and the printed circuit board; and a second connecting member directly connecting the second pin of the plug, to the printed circuit board, wherein a length of the plug case in the second direction is longer than a length of the second side of the case base, and the second direction is inclined at a predetermined angle with respect to the first direction.

* * * * *